US005678383A

United States Patent [19]

Danielewicz

[11] Patent Number: 5,678,383

[45] Date of Patent: Oct. 21, 1997

[54] CONSTRUCTION ASSEMBLY FOR SUPPORTING THIN PANELS

[76] Inventor: Ben Danielewicz, 80 Scenic Ridge Place NW, Calgary, Alberta, Canada, T3L 1V3

[21] Appl. No.: 586,287

[22] Filed: Jan. 16, 1996

[51] Int. Cl.[6] ..... E04C 2/34; E04B 2/00

[52] U.S. Cl. ..... 52/775; 52/235; 52/466

[58] Field of Search ..... 52/772, 773, 774, 52/775, 468, 235, 204.7, 204.69, 464, 466

[56] References Cited

U.S. PATENT DOCUMENTS

| | | | |
|---|---|---|---|
| 3,081,851 | 3/1963 | Hubbard | 52/464 X |
| 3,380,210 | 4/1968 | Neal et al. | 52/235 |
| 3,455,080 | 7/1969 | Meadows | 52/775 X |
| 3,932,974 | 1/1976 | Wright | 52/235 |
| 4,184,297 | 1/1980 | Casamayor | 52/202 |
| 4,648,231 | 3/1987 | Laroche | 52/775 |
| 5,018,326 | 5/1991 | Reynolds | 52/235 |
| 5,107,647 | 4/1992 | Danielewicz | 52/235 |
| 5,263,292 | 11/1993 | Holland et al. | 52/775 |

FOREIGN PATENT DOCUMENTS

| | | | |
|---|---|---|---|
| 1066472 | 11/1979 | Canada | 20/29 |
| 2030935 | 11/1994 | Canada | 20/33 |
| 2376927 | 9/1978 | France | 52/775 |
| 2811604 | 9/1979 | Germany | 52/775 |

*Primary Examiner*—Carl D. Friedman
*Assistant Examiner*—Winnie Yip
*Attorney, Agent, or Firm*—Anthony R. Lambert

[57] ABSTRACT

A construction assembly for attaching thin panels to a support frame. An elongate base strip suitable for attachment to a support frame. Two walls extending from the bases strip define a slot, one of the walls having plural teeth. A mating cover strip has a flexible projecting wall with plural teeth on one side facing the teeth of the slot but fewer in number. The cover strip and elongate base have thin panel support walls facing each other. The flexible projecting wall bends on a fulcrum attached to one of the second wall and the flexible projecting wall, such that upon insertion of the flexible projecting wall into the slot, the teeth are urged towards each other to grip a panel in the slot.

7 Claims, 9 Drawing Sheets

CONSTRUCTION ASSEMBLY FOR SUPPORTING THIN PANELS

FIELD OF THE INVENTION

This invention relates to fasteners used to attach thin panels to supporting frames.

BACKGROUND OF THE INVENTION

Earlier patents, including one to this proponent, have already been issued for a number of designs for supporting glazing or other thin panels. Many of those designs are for extruded aluminum or other metal components. These include U.S. Pat. Nos. 3,380,210; 3,932,974; 4,184,297 and Canadian Patent Number 1,066,472. These designs make specialised use of the mechanical strength and stiffness of metals and are not suited for poly vinyl chloride (PVC) applications. Several patents have also been issued for designs that are specifically intended for PVC. These are reviewed below.

Canadian Patent Number 953,070 covers a design for the assembly of partitions. In this design, clips are fixed onto the partitions. A "synthetic resin" core is used to connect the clips together. By its design, the partitions must be thick enough to hide the clip and resin core assembly, thus making it unsuitable for glass or other thin panels.

U.S. Pat. No. 4,184,297 covers a design for a one piece, hinged, co-extruded PVC fastener. The design includes applications for both central and perimeter areas of a wall. Because of its single barb lock and hinge, a component produced according to this design is only able to accept only one specific panel thickness. Furthermore, this design locks with a single locking tooth. Once released, from this single tooth, there is nothing to prevent the panel from falling completely away from the supporting frame. The design does not allow for variable angles for non co-linear panels.

U.S. Pat. No. 5,107,647 and Canadian Patent Number 2,030,935 (issued to this proponent) covers a "beam and block assembly" which does not depend on a separate supporting frame. The design does not include co-extrusions. It incorporates a very stiff junction between the base unit and the cover strip, making it particularly difficult to remove panels once installed. In addition, the design does not allow for variable angles for non co-linear panels.

SUMMARY OF THE INVENTION

The invention provides in one embodiment, a construction assembly for attaching thin panels, in various arrangements, to a supporting frame. In a first aspect of the invention, there is provided:

a construction assembly for attaching thin panels to a support frame, the construction assembly comprising:

an elongate base strip;

means to attach the elongate base strip to a support frame;

first and second walls spaced apart from each other and extending substantially perpendicularly away from the elongate base strip, the first and second walls defining a slot extending along the elongate base strip;

the first wall having a first toothed gripping surface facing the second wall, and a first thin panel support wall extending from the first wall in a direction away from the second wall and spaced from the elongate base strip;

an elongate cover strip including a second thin panel support wall and a flexible projecting wall extending substantially perpendicularly to the second thin panel support wall, the flexible projecting wall having a second toothed gripping surface and having a width substantially equal to the width of the slot;

a fulcrum attached to one of the second wall and the flexible projecting wall, such that upon insertion of the flexible projecting wall into the slot, the second toothed gripping surface is urged towards the first toothed gripping surface and grips the first toothed gripping surface with the first thin panel support wall facing the second thin panel support wall for receiving and supporting a thin panel between them; and the flexible projecting wall being sufficiently flexible that the flexible projecting wall may be removed from the slot.

In one embodiment, the elongate cover strip extends in a direction opposite to the second thin panel support wall to form a third thin panel support wall;

the flexible projecting wall includes first and second spaced apart flexible projecting wall segments, the second toothed gripping surface being formed on the first projecting wall segment facing away from the second projecting wall segment;

a third toothed gripping surface being formed on the second flexible projecting wall segment facing away from the first flexible projecting wall segment;

the second wall having a fourth toothed gripping surface facing the first wall, and a fourth thin panel support wall extending from the second wall parallel to the elongate base strip in a direction opposed to the first wall; and the fulcrum comprising a cross-bar interconnecting the first and second flexible projecting wall segments, such that upon insertion of the flexible projecting wall into the slot, the third toothed gripping surface is urged towards and grips the fourth toothed gripping surface, with the third thin panel support wall facing the fourth thin panel support wall for receiving and supporting a thin panel between them.

In a further embodiment, the fulcrum is formed on the second wall; and the elongate cover strip includes a supporting projecting wall extending perpendicularly to the second thin panel support wall adjacent to the flexible projecting wall, and spaced from the flexible projecting wall by approximately the width of the second wall.

The thin panel support surfaces preferably include flexible fins for flexibly gripping thin panels.

The thin panel support walls are preferably made from an extruded polymer such as PVC (polyvinylchloride).

The first wall preferably includes an extension extending beyond the first thin panel support wall for supporting a thin panel held between the first and second thin panel support walls.

The toothed gripping surfaces of the flexible projecting walls preferably have fewer teeth than the toothed gripping surface of the walls of the elongate base strip, and more than one but fewer than five teeth.

The construction assembly may include an outer wall connecting the first thin panel support wall to, and supporting the first thin panel support wall on, the elongate base strip.

In a further embodiment, the elongate base strip is formed of first and second strips;

the first strip forms a base for the first and second walls and includes a first elongate C-shaped element forming one side of a hinge;

the second strip includes a second elongate C-shaped element, complementary to the first elongate C-shaped element, for mating with the first elongate C-shaped element to form a hinge.

The components of the invention preferably have a uniform cross section along their entire length.

Further aspects of the invention are described in the detailed description and claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
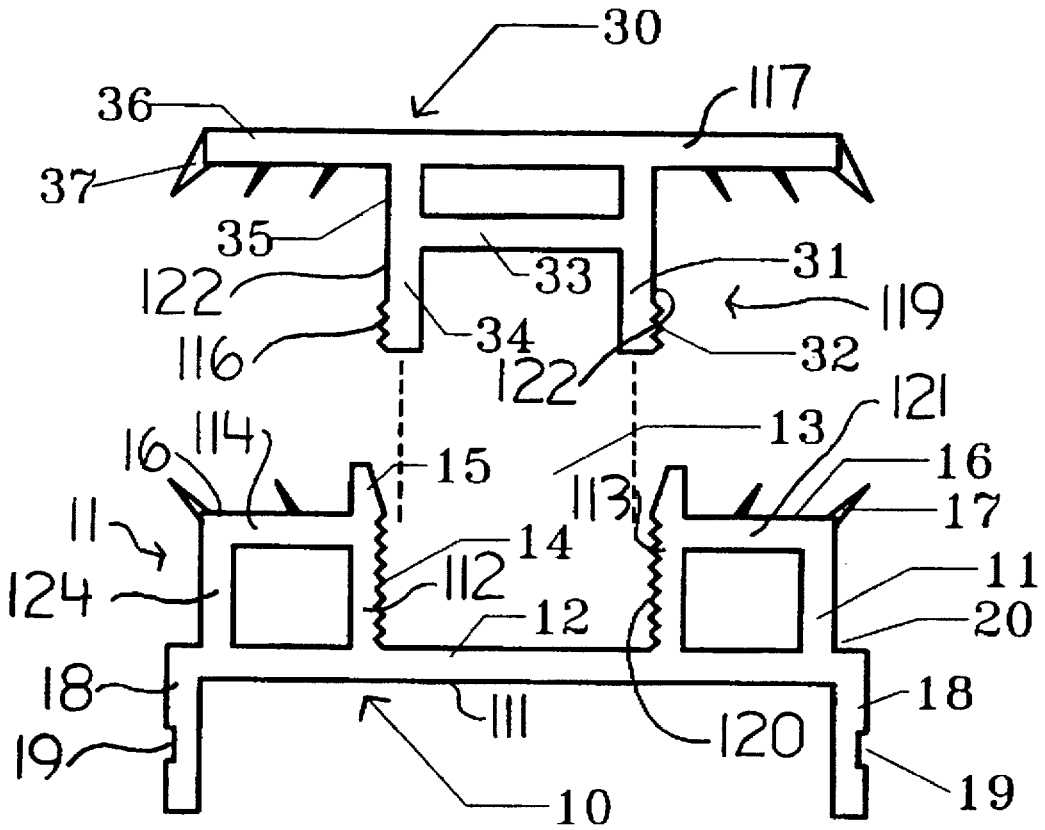
FIG. 1 is a cross section of a first embodiment of the base unit and its corresponding first cover unit.

The features of a first base unit 10 and corresponding first cover unit 30 together forming a construction assembly are illustrated in FIG. 1. The first base unit and first cover unit can be formed by extrusion of a flexible PVC material to any practical length.

Figure 5:
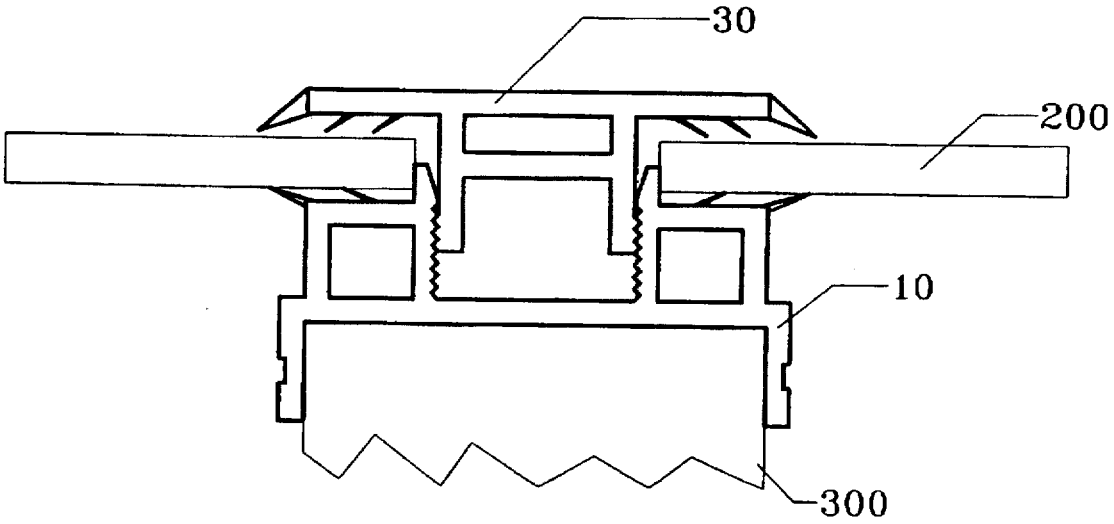
FIG. 5 shows an assembly of the components in FIG. 1 holding in place two panels and mounted on a supporting frame.

The base unit 10 includes an elongate base strip 111 having means to attach the elongate base strip to a support frame, for example the support frame being formed at least in part by a 2×4 as illustrated in FIG. 5. The attaching means may include a projecting side 18 that may be press fit onto the support frame, slots 19 running along the length of the projecting side 18 of the elongate base strip 111, through which slots may be forced any of various fasteners, such as nails, screws and the like. In addition, fasteners may be applied through the wall 12 into the supporting frame.

A pair of walls 112 and 113 are spaced apart from each other and extend substantially perpendicularly away from the elongate base strip 111 and define between them a slot 13 extending along the elongate base strip. The wall 112 has teeth forming a toothed gripping surface 14 facing the wall 113. A thin panel support wall 114 extends away from the wall 112 in a direction away from the wall 113 and is spaced from the elongate base strip 111. A rectangle 11 is completed by outer wall 124 connecting the thin panel support wall 114 to, and supporting the thin panel support wall 114 on, the elongate base strip 111. The two rectangles 11 on either side of the elongate base strip 111 are constructed in similar fashion.

Elongate cover strip 30 includes a thin panel support wall 36 and a flexible projecting wall 35 extending substantially perpendicularly to the thin panel support wall 36. The flexible projecting wall 35 has a toothed gripping surface 116 and has a width substantially equal to the width of the slot 13.

As shown in the embodiment of FIG. 1, the elongate cover strip 30 extends in a direction opposite to the thin panel support wall 36 to form a thin panel support wall 117. The flexible projecting wall 35 includes a pair of spaced apart flexible projecting wall segments 31 and 34. The toothed gripping surface 116 is formed on the projecting wall segment 34 facing away from the projecting wall segment 31. A toothed gripping surface 119 is also formed on the flexible projecting wall segment 31 facing away from the flexible projecting wall segment 34. The wall 113 has a toothed gripping surface 120 facing the wall 112. A thin panel support wall 121 extends from the wall 113 parallel to the elongate base strip 111 in a direction away from the wall 112.

A cross-bar 33 interconnecting the flexible projecting wall segments 31 and 34 forms a fulcrum, such that upon insertion of the flexible projecting wall 35 into the slot 13, the toothed gripping surface 116 deflects away from the wall 112 as its teeth ride over the teeth of the gripping surface 14, but is urged towards the toothed gripping surface 14 by pressure from the fulcrum, and the toothed gripping surface 14 grips the toothed gripping surface 116 with the thin panel support wall 114 facing the thin panel support wall 36 for receiving and supporting a thin panel (not shown) between them. The flexible projecting wall 35, and consequently the flexible projecting wall segments 31, 34 should be sufficiently flexible that the flexible projecting wall 35 may be removed from the slot 13. The cross-bar 33 functions such that upon insertion of the flexible projecting wall 35 into the slot 13, the toothed gripping surface 119, as it rides over the toothed gripping surface 120, is urged towards and grips the toothed gripping surface 120, with the thin panel support wall 117 facing the thin panel support wall 121 for receiving and supporting a thin panel (not shown) between them.

The first base unit 10 thus effectively consists of two hollow rectangular elements 11 joined by a common base 12 to form the slot 13. The opening of the slot 13 contains raised lips or wall extensions 15 (extensions of the walls 112 and 113), extending beyond the thin panel support walls 114 and 121, which act as a stop for the panel that is held by the construction assembly. The raised lips 15 are tapered to allow for easier insertion of the wall 35 of cover strip 30 during assembly. Flat surfaces 16 along the two thin panel support walls 114 and 121, against which a panel is held in use, contain one or more fins 17 of flexible material which flexibly grip and cushion the panel in the assembly and provide a seal and support between the first base unit and the panel. The fins are preferably co-extruded in known fashion with the respective ones of the thin panel support walls to which they are attached.

The junction between the extensions 18 and the rectangular elements 11 forms an indentation 20 which can be used to attach a cladding unit 100 (See FIG. 8) to the first base unit 10.

The placement of the cross-bar or brace 33 along the extensions 31, 34 is selected in order to define the length over which bending of the extensions 31, 34 is allowed to occur, thus determining the stiffness of those extensions and consequently the ease of joining and separating the first cover unit 30 and the base unit 10. The extensions 31 and 34 include a smooth section 122 which rests on the outer tips of the teeth of the toothed gripping surfaces 120 and 14 respectively, thereby keeping the extensions 31, 34 parallel to the walls of the slot 13 when the first cover unit 30 is inserted into the first base unit 10. The thin panel support walls 36 and 117 each contain one or more flexible fins 37 of flexible material which cushion the panel in the assembly and provide a seal between the first cover unit and the panel.

Figure 2:
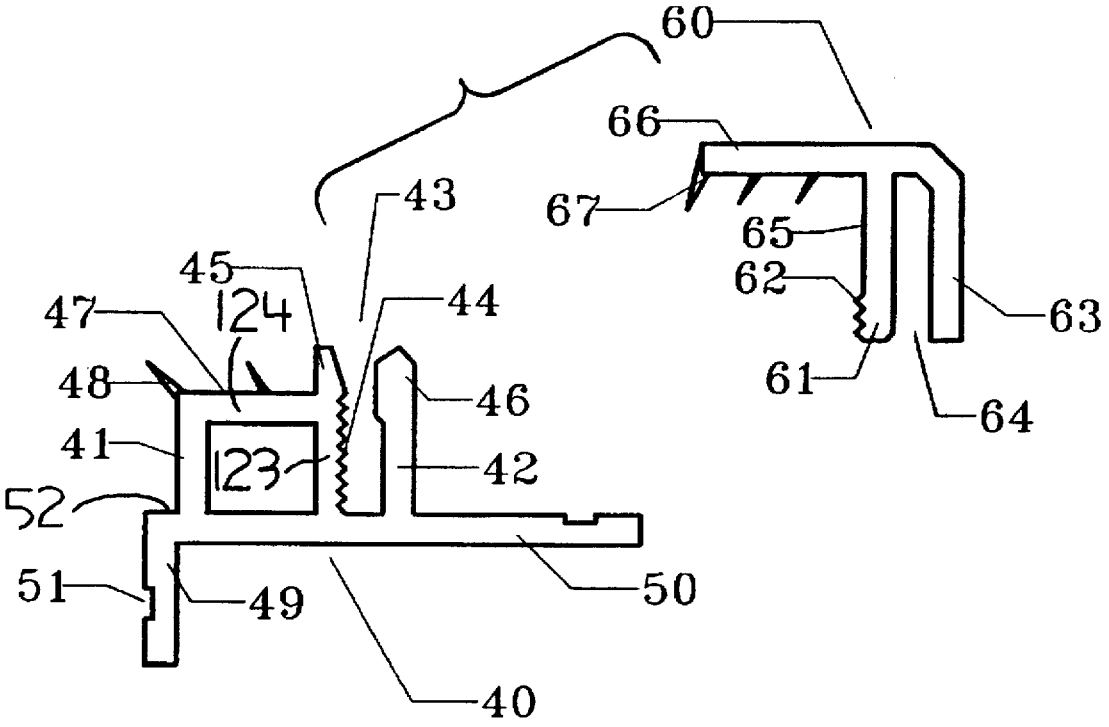
FIG. 2 is a cross section of a second embodiment of the base unit and its corresponding second cover unit.

The features of a second embodiment of the base unit and the corresponding second embodiment of the cover unit are illustrated in FIG. 2. The second base unit 40 and second cover unit can be formed by extrusion to any practical length.

In the embodiment of FIG. 2, the fulcrum is formed on the wall 42 by thickened segment 46, and the elongate cover strip 60 includes a supporting projecting wall 63 extending perpendicularly to the thin panel support wall 66 adjacent to the flexible projecting wall 65, and spaced from the flexible projecting wall 65 by approximately the width of the wall 42.

The second base unit 40 effectively consists of one hollow rectangular element 41, bounded on one side by wall 123 and an adjacent free standing wall 42 which form a slot 43. The side of the slot 43 farthest from the wall 42 has teeth forming a toothed gripping surface 44 along most of its length. The opening of the slot 43 contains a raised lip or wall extension 45 (an extension of wall 123) on the rectangular element 41 which acts as a stop for the panel that is held by the fastener. The raised lip 45 is tapered to allow for easier insertion of the second cover unit 60 during assembly. The wall 42 contains a thicker portion 46 forming a fulcrum at its free end which is used to ensure that the grip of the second cover unit within the second base unit 40 is independent of the depth to which the second cover unit 60 is inserted into the base unit 40. The width of the thicker portion 46, that is, in a direction normal to the slot 43, is equal to or greater than the width of the teeth 44 along the same direction. The length of the thicker portion 46, that is, in the direction parallel to the slot 43, is selected according to the stiffness of the material from which the component is constructed.

A flat surface 47 along thin panel support wall 124 of the hollow rectangular element 41 forms the platform on which the panel is held. This flat surface 47 contains one or more fins 48 of flexible material which cushion the panel in the assembly and provide a seal between the panel and the second base unit 40. The second base unit 40 has two extensions 49 and 50 by which means or like means the second base unit 40 may be connected to the supporting frame. The extensions 49 and 50 include indentations 51 which can accommodate the heads of nails, screws or similar devices that can be used to attach the second base unit to the supporting frame. The junction between the extensions 49 and the rectangular elements 41 forms an indentation 52 to which a cladding unit 100 (FIG. 5) can be attached.

One wall of the second cover strip 60 forms a thin panel support wall 66 which retains the panel against the second base unit when the two components are mated. Thin panel support wall 66 contains one or more fins 67 of flexible material which cushion the panel in the assembly and provide a seal between the second cover unit and the panel.

The second cover strip 60 contains a flexible projecting wall 61 which is of an appropriate width and length to fit into the slot 43 of the second base unit 40. The flexible projecting wall 61 has toothed gripping surface 62 containing one or more teeth which engage into the teeth of toothed gripping surface 44 of the second base unit 40 in order to retain the second cover strip 60 within the second base unit 40.

The second cover strip 60 contains a supporting projecting wall 63 extending perpendicularly to the thin panel support wall 66 adjacent to the flexible projecting wall 61. When the cover strip 60 is mated to the base unit 40, the supporting projecting wall 63 slides along the side of the wall 42 that is farthest from the rectangular element 41 of the second base strip 40 when those two units are mated. The walls 61 and 63 define a slot 64 into which the wall 42 of the second base unit 40 fits when the two components are mated. Supporting projecting wall 63 provides added support to the wall 42 of the second base unit 40, in order to ensure a firm fit between these two components. The flexible projecting wall 61 includes a smooth section 65 which rests on the outer tips of the teeth of the toothed gripping surface 44 of the second base unit 40, thereby keeping flexible projecting wall 61 parallel to the walls of the slot 43 when the second cover strip 60 is mated with the second base unit 40.

The fulcrum formed by the enlargement 46 ensures that the toothed gripping surface 62 is urged towards the toothed gripping surface 44 and grips the toothed gripping surface 44 with the thin panel support wall 66 facing the thin panel support wall 47 for receiving and supporting a thin panel between them. The flexible projecting wall 61 should be sufficiently flexible that the flexible projecting wall may be removed from the slot 43, without destroying it. The flexible projecting wall and the other components described here are thus preferably made from PVC or similar material.

Figure 3:
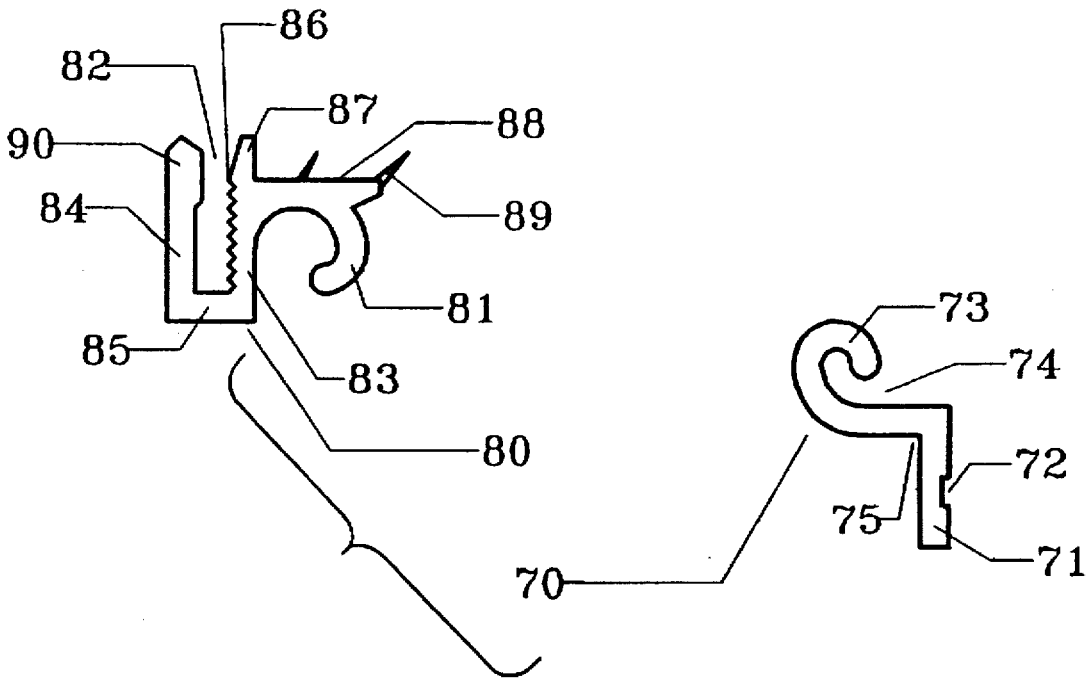
FIG. 3 is a cross section of a two part hinged base unit assembly which mates with the second cover unit from FIG. 2.

A hinged base unit assembly is illustrated in FIG. 3. The base of the hinge assembly and the rotating insert can be formed by extrusion to any practical length.

The elongate base strip of FIG. 3, is formed of two strips, namely hinge insert 80, mating with hinge base 70 to complete a hinged base unit. The second cover strip 60 mates with the hinge insert 80 in order to attach the panel to the hinged base unit. The hinge base 70 includes a wall extension 71 which includes an indentation 72 which can accommodate the heads of nails, screws or similar devices that can be used to attach the hinge base to the supporting frame. The hinge base 70 includes an elongate C-shaped element or curved extension 73, which forms a curved slot 74 into which a complementary elongate C-shaped element 81 of the insert 80 can fit to complete the hinge. A right angle at the location 75 is defined by the junction of the curved extension 73 and the extension 71. The corner of the supporting frame fits into this right angle. In the insert 80, the walls 83 and 84 are joined by a base 85, forming part of the elongate base strip, and define a slot 82. The side of slot 82, defined by wall 83, contains teeth of a toothed gripping surface 86 along most of its length. The teeth 86 engage into the teeth of toothed gripping surface 62 of the second cover unit 60 when the two components are mated. The opening of the slot 82 contains a raised lip or wall extension 87 which acts as a stop for the panel that is held by the fastener. The raised lip 87 is tapered to allow for easier insertion of the second cover unit 60 during assembly. A flat surface of a thin panel support wall 88, located adjacent to the C-shaped element 81, forms a platform on which a panel may be held. This flat surface contains one or more fins 89 of flexible material which cushion the panel in the assembly and provide a seal between the insert 80 and the panel. The wall 84 contains a thicker portion 90 at its free end forming a fulcrum, similar in function to the thicker portion 46 of FIG.

2, which is used to ensure that the grip of the of the second cover unit 60 within the hinged base unit 80 is independent of the depth to which the second cover unit is inserted into the base unit, and to urge the teeth of toothed gripping surface 62 towards the teeth of toothed gripping surface 86. The width of the thicker portion 90, that is, in a direction normal to the slot 82, is equal to or more than the width of the teeth 86 along the same direction. The length of the thicker portion 90, that is, in the direction parallel to the slot 82, is selected according to the stiffness of the material from which the component is constructed.

The number of teeth on any of the toothed gripping surfaces of the cover strips of FIGS. 1 or 2 should be less than the number of teeth on the toothed gripping surfaces on the base strip. It is preferred that 2, 3, 4 or 5 teeth be used on the flexible projecting walls, with three being most preferred. If too few teeth are used, for example only one, the teeth need to be so big for heavy panels such as glass that, firstly, it is hard to remove the flexible projecting walls from the slots and, secondly, the large steps in which the two units fit together could make it difficult to ensure that every panel thickness will fit snugly. For some thicknesses of panel, the fit may be too tight with the teeth in one position, but too loose at the next. Plural smaller teeth are thus preferred. Yet, the number of teeth on the flexible projecting wall should be less than the number of teeth on the wall extending from the elongate base strip. With a smaller number of teeth, for example three, on the flexible projecting wall, essentially the same number of teeth hold the elongate cover strip in over a wide range of depth of insertion. Otherwise, if the same number of teeth were used on each facing toothed gripping surface, then the thicker the panel, the fewer teeth hold the panel, which is not a desirable situation. The use of the fulcrum of FIG. 2 particularly further increases the grip on the panel when the teeth are only partially inserted so that thick panels are in fact gripped more tightly than thin panels.

Figure 4:
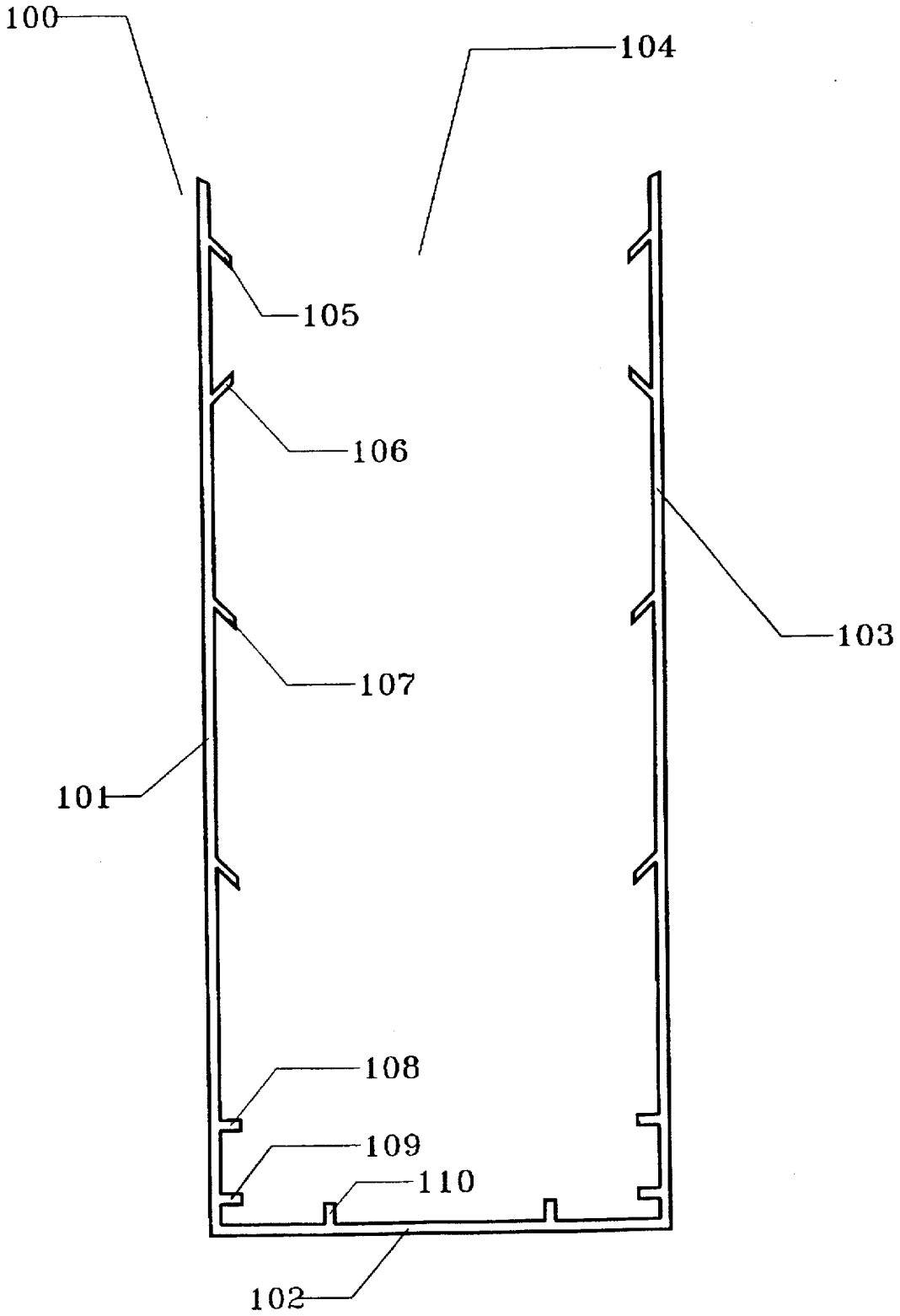
FIG. 4 is a cross section of a cladding which locks into the base units illustrated in FIG. 1, FIG. 2 and FIG. 3.

The features of a cladding unit are illustrated in FIG. 4. This component can be formed by extrusion to any practical length.

Figure 9:
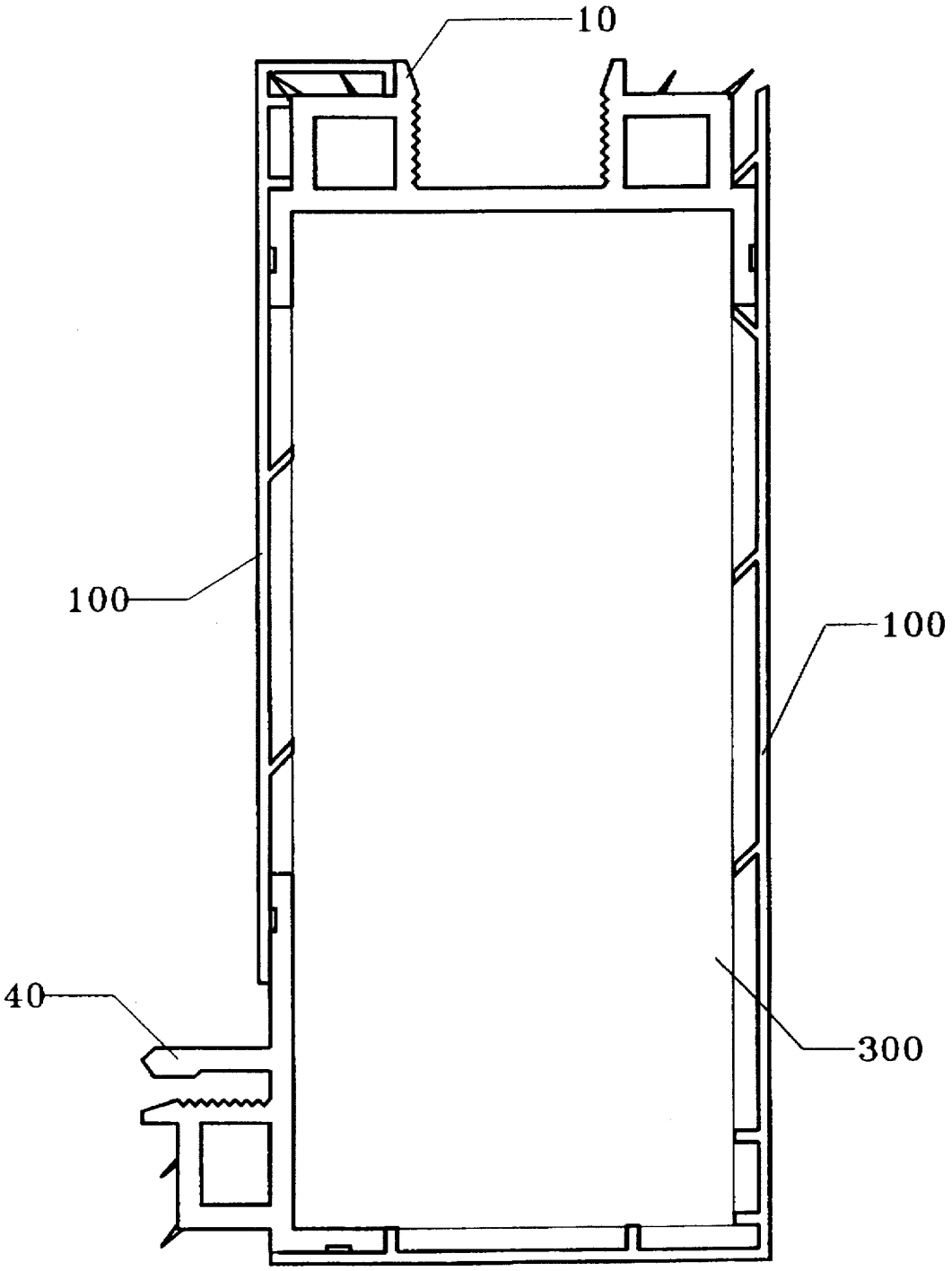
FIG. 9 illustrates an assembly of the base units from FIG. 1, FIG. 2 and sections of the cladding unit from FIG. 4 mounted on a supporting frame.

The cladding unit 100 consists of three walls 101, 102 and 103 which are joined at right angles in order to form the three sides of a rectangle and defining a slot 104. Several extensions 105, 106, 107, 108, 109 and 110 extend into the slot 104 from the three walls 101, 102 and 103. The position and size of extension 105 allows it to fit into indentation 20 in the first base unit 10, and into indentation 52 in the second base unit 40 and into the indentation 74 of the hinge base 70. When extension 105 is in place in any of these indentations, it locks the cladding unit 100 in place around the supporting frame. The position of extension 106 is such that it engages the tip of extension 18 in the first base unit, the tip of extension 49 in the second base unit and the tip of extension 71 of the hinge base 70 in order to prevent the cladding from being pushed farther onto those units when it is used in combination with them. The length of extensions 106, 107, 108, 109 and 110 is determined by the desired separation of the cladding unit walls 101, 102 and 103 from the supporting frame. The positions of extensions 107 are selected to provide adequate support for the cladding when they are resting against the supporting frame. The position of extension 109 is such that it can act as a guide for cutting the cladding when it is used for covering the inside of a corner frame member as illustrated in FIG. 9. The position of extension 110 is such that it can act as a guide for cutting the cladding when it is used for covering the outside of a corner frame member as illustrated in FIG. 9.

FIG. 5 illustrates, in cross section, an assembly of components that might be used in the central portion of a wall of a structure. It shows the first base unit 10 assembled with the first cover unit 30 and retaining two co-linear panels 200. The entire assembly is shown in position on a supporting frame 300.

Figure 6:
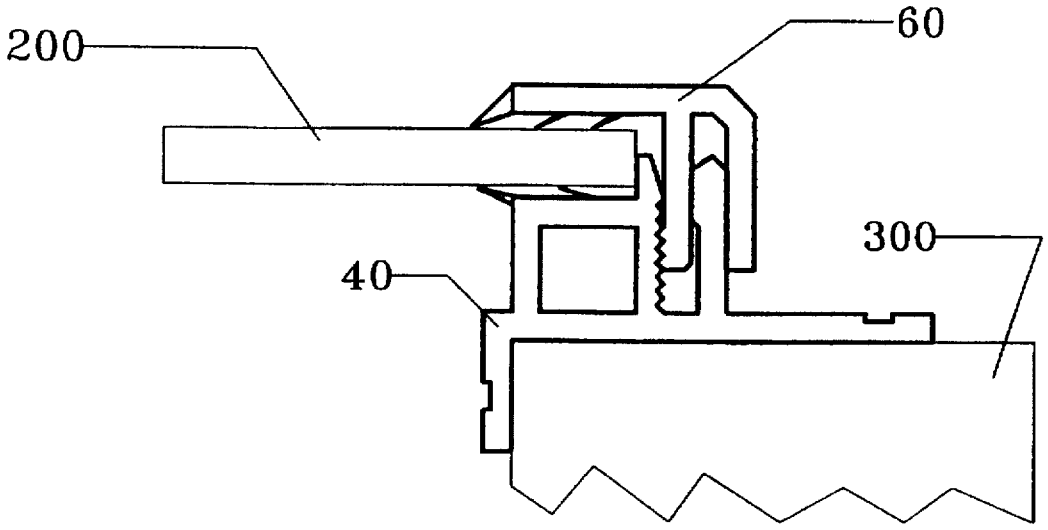
FIG. 6 illustrates an assembly of the components in FIG. 2 holding in place one panel and mounted on a supporting frame.

FIG. 6 illustrates, in cross section, an assembly of components that might be used around the perimeter of a wall of a structure. It shows the second base unit 40 assembled with the second cover unit 60 and retaining a panel 200. The entire assembly is shown in position on a supporting frame 300.

Figure 7:
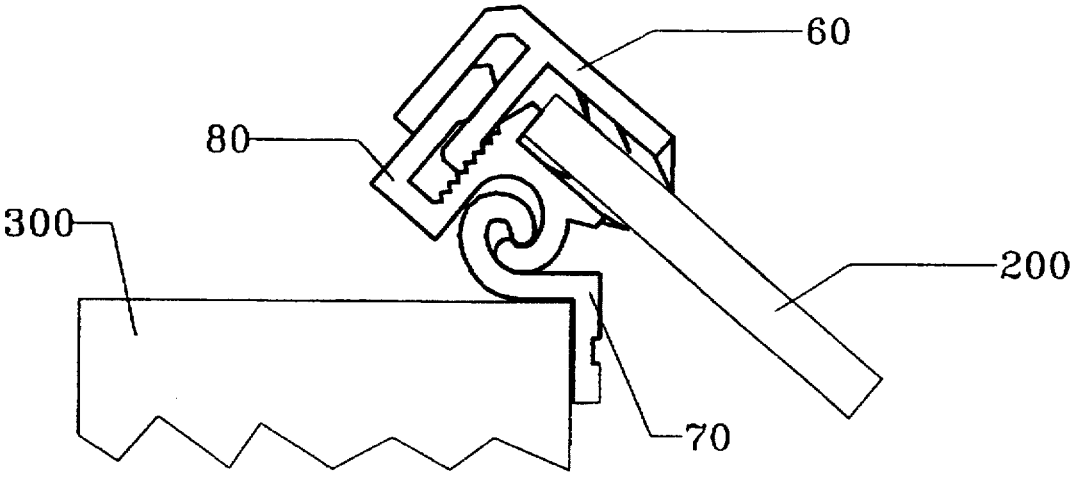
FIG. 7 illustrates an assembled hinge from components illustrated in FIG. 2 and FIG. 3 and mounted on a supporting frame.

FIG. 7 illustrates, in cross section, an assembly of components that might be used in an application where a panel does not make a right angle with the supporting frame. It shows the base unit of the hinge assembly 70, mated with the rotating insert of the hinge assembly 80, assembled with the second cover unit 60 and retaining a panel 200. The entire assembly is shown in position on a supporting frame 300.

Figure 8:
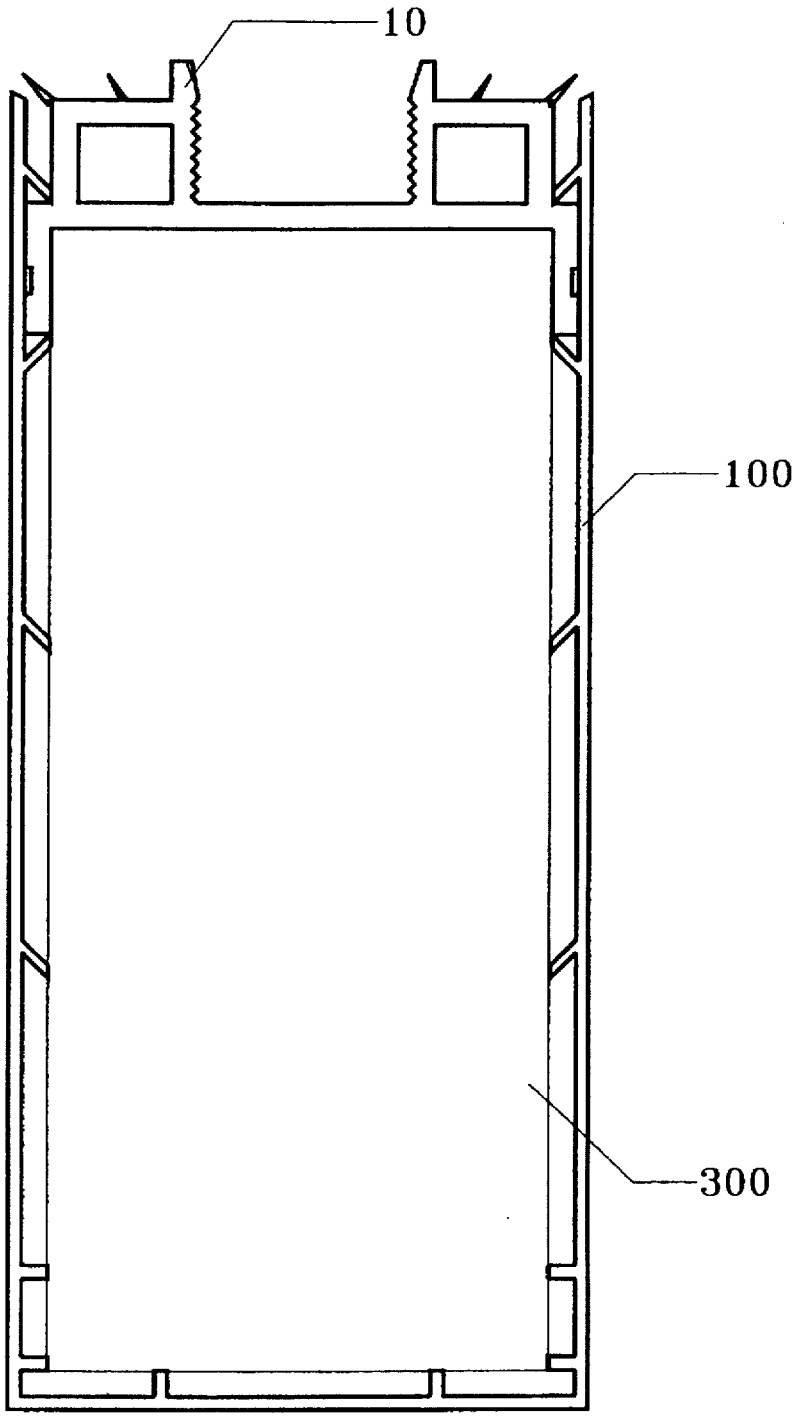
FIG. 8 illustrates an assembly of the base unit from FIG. 1 and the cladding from FIG. 4 and mounted on a supporting frame.

FIG. 8 illustrates, in cross section, the first base unit 10 assembled with the cladding unit 100. The entire assembly is shown in position around a supporting frame 300.

FIG. 9 illustrates in cross section, an assembly of components that might be used at a corner of a structure. It shows the first base unit 10 and the second base unit 40 in position on a supporting frame 300. Two separate sections of the cladding unit 100 are shown attached to the base units.

Applications may include the construction of greenhouses, sun rooms, pool enclosures, wind screens, railings, and solar panel assemblies. In addition, the design is suitable for making firm, semi-permanent attachments of panels, such as would be used in partition walls or in suspended ceilings, to conventional framing. The fasteners consist of co-extrusions of both rigid and flexible poly vinyl chloride components.

The construction assembly of the invention may be used to:

a) Rigidly attach two adjacent panels, in one plane, to one supporting frame member, such as would be found in the central area of a wall containing several supporting frame members;

b) Rigidly attach a single panel to one supporting frame member, such as would be found at the perimeter of a wall; and, c) Attach a single panel, to a supporting frame member, at a range of angles about an axis of rotation that is parallel to the length of the supporting frame member, such as would be found in a curved wall constructed from several straight panels.

The design also includes two variations of cover strips, which hold the panels against the base units described above. The two variations of cover strips:

a) Retain two panels when used with the base unit described in (a) above; and, b) Retain one panel, when used with the base units described in (b) and (c) above.

Finally, the design includes a cladding unit, which locks into the base units and, extending around the supporting frame member, encloses it. 0

The embodiments of the invention in which an exclusive property or privilege is claimed are defined as follows:

1. A construction assembly for attaching thin panels to a support frame, the construction assembly comprising:

an elongate base strip;

means for attaching the elongate base strip to a support frame;

first and second walls spaced apart from each other and extending substantially perpendicularly away from the elongate base strip, the first and second walls defining a slot extending along the elongate base strip, the slot having a first width;

the first wall having a first toothed gripping surface facing the second wall, and a first thin panel support wall extending from the first wall in a direction away from the second wall and spaced from the elongate base strip;

the second wall having a second toothed gripping surface facing first wall, and a second thin panel support wall extending from the second wall parallel to the elongate base strip in a direction opposed to the first wall;

an elongate cover strip comprising first and second flexible projecting walls extending substantially perpendicularly to the elongate cover strip, the elongate cover strip extending away from the first and second flexible projecting walls to form third and fourth thin panel support walls, the first and second flexible projecting walls having opposed third and fourth toothed gripping surfaces and being spaced apart to have a second width substantially equal to the width of the slot; and a cross-bar spaced apart from the elongate cover strip and forming a fulcrum interconnecting the first and second flexible projecting walls, such that upon insertion of the first and second flexible projecting walls into the slot, the third and fourth toothed gripping surfaces are urged towards and grip the first and second toothed gripping surfaces respectively by the cross-bar, with the first and second thin panel support walls facing the third and fourth thin panel support walls respectively for receiving and supporting a thin panel between them.

2. The construction assembly of claim 1 in which the first and second flexible projecting walls are sufficiently flexible that the first and second flexible projecting walls are removable from the slot.

3. The construction assembly of claim 1 in which each of the thin panel support walls comprises flexible fins for flexibly gripping thin panels.

4. The construction assembly of claim 1 in which each of the thin panel support walls is made from an extruded polymer, and each of the thin panel support walls comprises co-extruded flexible fins for flexibly gripping thin panels.

5. The construction assembly of claim 1 in which the first wall includes an extension extending beyond the first thin panel support wall for supporting a thin panel held between the first and third thin panel support walls.

6. The construction assembly of claim 1 further comprising:

an outer wall connecting the first thin panel support wall to, and supporting the first thin panel support wall on, the elongate base strip.

7. The construction assembly of claim 1 in which the means for attaching the elongate base strip to a support frame comprises first and second projecting side walls extending along the elongate base strip for press fitting onto the support frame.

* * * * *